US011473733B2

(12) United States Patent
Aguiar et al.

(10) Patent No.: US 11,473,733 B2
(45) Date of Patent: Oct. 18, 2022

(54) FOOT FOR A PORTABLE PRESSURIZED GAS CYLINDER

(71) Applicant: AMTROL Licensing Inc., West Warwick, RI (US)

(72) Inventors: Carlos Aguiar, Oporto (PT); Carla Aguiar, Vila Nova de Gaia (PT)

(73) Assignee: AMTROL LICENSING INC., West Warwick, RI (US)

( * ) Notice: Subject to any disclaimer, the term of this patent is extended or adjusted under 35 U.S.C. 154(b) by 180 days.

(21) Appl. No.: 16/287,333

(22) Filed: Feb. 27, 2019

(65) Prior Publication Data

US 2020/0271276 A1 Aug. 27, 2020

(51) Int. Cl.
*F17C 1/00* (2006.01)
*F17C 13/08* (2006.01)

(52) U.S. Cl.
CPC .... *F17C 13/084* (2013.01); *F17C 2201/0109* (2013.01); *F17C 2205/0103* (2013.01); *F17C 2205/018* (2013.01); *F17C 2205/0126* (2013.01)

(58) Field of Classification Search
CPC ..... F17C 13/084; F17C 2201/0109; F17C 2205/0103
USPC ..... 248/146, 346.01, 688; 220/581, 23.91, 220/586
See application file for complete search history.

(56) References Cited

U.S. PATENT DOCUMENTS 4,907,712 A * 3/1990 Stempin ..... F17C 13/084 220/630
7,699,188 B2 * 4/2010 Oliveira ..... F17C 13/003 220/586
8,215,517 B2 * 7/2012 Chohfi ..... F17C 13/123 220/23.91
2010/0147859 A1 * 6/2010 Chohfi ..... F17C 1/14 16/110.1
2011/0140412 A1 6/2011 Manser
2014/0231439 A1 * 8/2014 Manser ..... F17C 13/084 248/154
2019/0353305 A1 * 11/2019 Aguiar ..... F17C 13/04

FOREIGN PATENT DOCUMENTS

DE 202015105945 3/2016

OTHER PUBLICATIONS

Notification of Transmittal of the Intl. Search Report and the Written Opinion of the Intl. Searching Authority; PCT/US2020/019222; dated Jun. 23, 2020; 16 pages.

* cited by examiner

*Primary Examiner* — Todd M Epps
(74) *Attorney, Agent, or Firm* — Tucker Ellis, LLP

(57) ABSTRACT

Provided is a foot ring secured to a tank having a collar, The foot ring includes a base having an inner and outer surface, a central portion, and an outer peripheral portion, a plurality of circumferentially spaced deflectable longitudinal lock tabs extending around the base for securing the foot ring to the tank, and a plurality of circumferentially spaced deflectable rotational lock tabs extending around the base for preventing rotational movement of the foot ring relative to the tank. Each of the circumferentially spaced deflectable longitudinal lock tabs have a first projection and a catch extending from the first projection for engaging a flange of the collar, and each of the circumferentially spaced deflectable rotational lock tabs have a second projection configured to be received in a respective notch in the flange.

18 Claims, 17 Drawing Sheets

FOOT FOR A PORTABLE PRESSURIZED GAS CYLINDER

TECHNICAL FIELD

In general, the present invention relates to a portable pressurized gas cylinder, and in particular to a foot for a portable pressurized gas cylinder.

BACKGROUND OF THE INVENTION

A variety of pressurized gas cylinders have been used for storage and transportation of pressurized gas products for household and industrial. For example, the cylinders may be used for the storage of gas for cooking appliances such as stoves or grills. Many of these cylinders have traditionally been fabricated of steel with a steel cylindrical body having a valve at the top for controlling the flow of gas from the cylinder and a footing at the bottom to provide stability for the cylinder upon a supporting surface. When steel cylinders are taken indoors, for example, inside a kitchen or into other living areas of the home, the footing tends to leave rust stains on the flooring or carpeting of the home.

SUMMARY OF THE INVENTION

In accordance with an embodiment of the present invention, a foot ring configured to be secured to a tank having a collar is provided. The foot ring includes a base having an inner and outer surface, a central portion, and an outer peripheral portion, a plurality of circumferentially spaced deflectable longitudinal lock tabs extending around the base for securing the foot ring to the tank, each of the circumferentially spaced deflectable longitudinal lock tabs having a first projection and a catch extending from the first projection for engaging a flange of the collar, and a plurality of circumferentially spaced deflectable rotational lock tabs extending around the base for preventing rotational movement of the foot ring relative to the tank, each of the circumferentially spaced deflectable rotational lock tabs having a second projection configured to be received in a respective notch in the flange.

In accordance with an embodiment of the present invention, a portable gas cylinder is provided that includes a gas tank having an upper portion, a lower portion, and a collar, the collar including a base secured to the lower portion, a flange extending around and radially outwardly from the base, and a plurality of notches circumferentially spaced around the flange, and a foot ring configured to be attached to the gas tank, the foot ring including a base having an inner and outer surface, a central portion, and an outer peripheral portion, a plurality of circumferentially spaced deflectable longitudinal lock tabs extending around the base for securing the foot ring to the tank, each of the circumferentially spaced deflectable longitudinal lock tabs having a first projection with an inner surface configured to abut a radially outer surface of the flange, and a catch extending from the first projection for engaging an underside of the flange to secure the foot ring to the tank, and a plurality of circumferentially spaced deflectable rotational lock tabs extending around the base for preventing rotational movement of the foot ring relative to the tank, each of the circumferentially spaced deflectable rotational lock tabs having a second projection configured to be received in a respective one of the notches.

In accordance with an embodiment of the present invention a method of attaching a foot ring to a tank having a collar with a flange is provided. The method includes advancing the foot ring toward the collar until a plurality of circumferentially spaced deflectable longitudinal lock tabs are engaged with the collar to secure the foot ring to the tank, wherein each of the circumferentially spaced deflectable longitudinal lock tabs have a first projection with an inner surface that abuts a radially outer surface of the flange and a catch extending from a respective one of the first projections for engaging an underside of the flange, and rotating the foot ring until a plurality of circumferentially spaced deflectable rotational lock tabs engage with notches in the flange thereby preventing rotational movement of the foot ring relative to the tank.

These and other objects of this invention will be evident when viewed in light of the drawings, detailed description and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein:

FIG. 19 is still another perspective view of the foot ring being attached to the gas tank with a portion of the foot ring cut away.

DETAILED DESCRIPTION OF THE INVENTION

Figure 1:
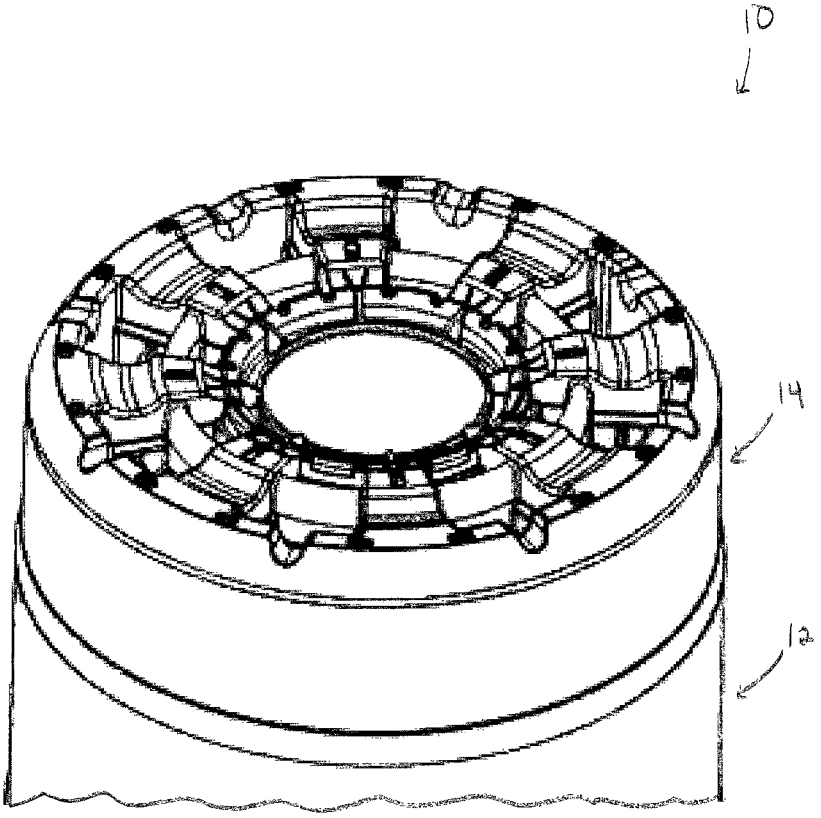
FIG. 1 is a bottom perspective view of a portable gas cylinder.

Embodiments of the invention relate to methods and systems that relate to a portable gas cylinder. The cylinder has a gas tank having an upper portion, a lower portion, and a collar, the collar including a base secured to the lower portion, a flange extending around and radially outwardly from the base, and a plurality of notches circumferentially spaced around the flange. The cylinder also includes a foot ring configured to be attached to the gas tank. The foot ring includes a base having an inner and outer surface, a central portion, and an outer peripheral portion, a plurality of circumferentially spaced deflectable longitudinal lock tabs extending around the base for securing the foot ring to the tank, each of the circumferentially spaced deflectable longitudinal lock tabs having a first projection with an inner surface configured to abut a radially outer surface of the flange, and a catch extending from the first projection for engaging an underside of the flange to secure the foot ring to the tank, and a plurality of circumferentially spaced deflectable rotational lock tabs extending around the base for preventing rotational movement of the foot ring relative to the tank, each of the circumferentially spaced deflectable rotational lock tabs having a second projection configured to be received in a respective one of the notches.

With reference to the drawings, like reference numerals designate identical or corresponding parts throughout the several views. However, the inclusion of like elements in different views does not mean a given embodiment necessarily includes such elements or that all embodiments of the invention include such elements. The examples and figures are illustrative only and not meant to limit the invention, which is measured by the scope and spirit of the claims.

Figure 2:
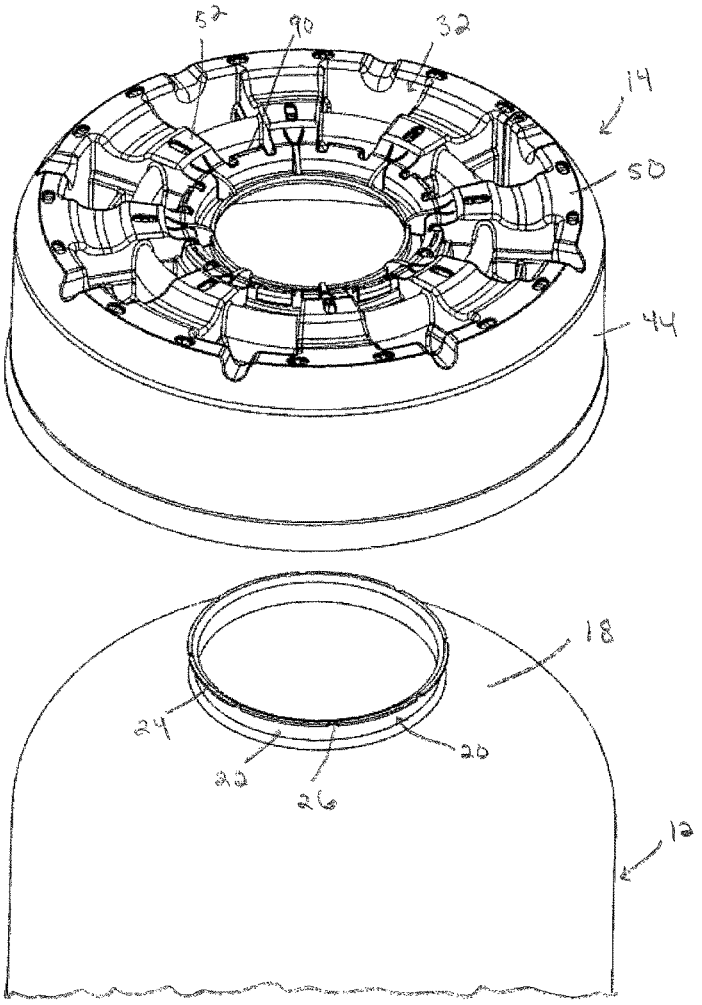
FIG. 2 is an exploded bottom perspective view of the portable gas cylinder.

Turning now to FIGS. 1 and 2, a portable gas cylinder is shown generally at reference numeral 10. The portable gas cylinder 10 is shown with a bottom of the cylinder facing up and a top of the cylinder facing down. The gas cylinder 10 includes a gas tank 12 configured to store a suitable pressurized gas, and a cylinder stand or foot ring 14 attached to the gas tank 12. The gas tank 12 may be made of a suitable material, such as metal, and the foot ring 14 may be made of a suitable non-metal material, such as plastic. The gas tank 12 includes an upper portion (not shown) having a valve port (not shown), a lower portion 18, and a collar 20 secured to the lower portion 18. A suitable handle assembly may be attached to the gas tank 12 at the upper portion. The gas tank 12 can include one or more liners of a material. For instance, the gas tank 12 can include a liner made of a first material, which may be at least one of a plastic, a metal, a steel, a thermoplastic, among others. In certain embodiments, the container can include a wrapping of a second material, which may be at least one of a carbon fiber, a composite material, a Teflon, or a disparate material from the first material.

The collar 20 may be secured to the lower portion 18 in any suitable manner, such as by welding, or may alternatively be integrally formed with the lower portion 18. The collar 20, which is shown as a circular collar, includes a base 22 that is attached to the lower portion 18, and a flange 24 extending around and radially outwardly from the base 22. The flange 24 includes a plurality of notches 26 circumferentially spaced around the flange 24 inward from an edge of the flange 24. The collar 20 may be made of a suitable material, such as metal, and may be made in a suitable manner, such as pressing. The notches 26 prevent the metal collar 20 from cracking as it is bent during pressing and additionally serve to receive rotational lock clips on the foot ring 14 as will be described below in detail.

Figure 3:
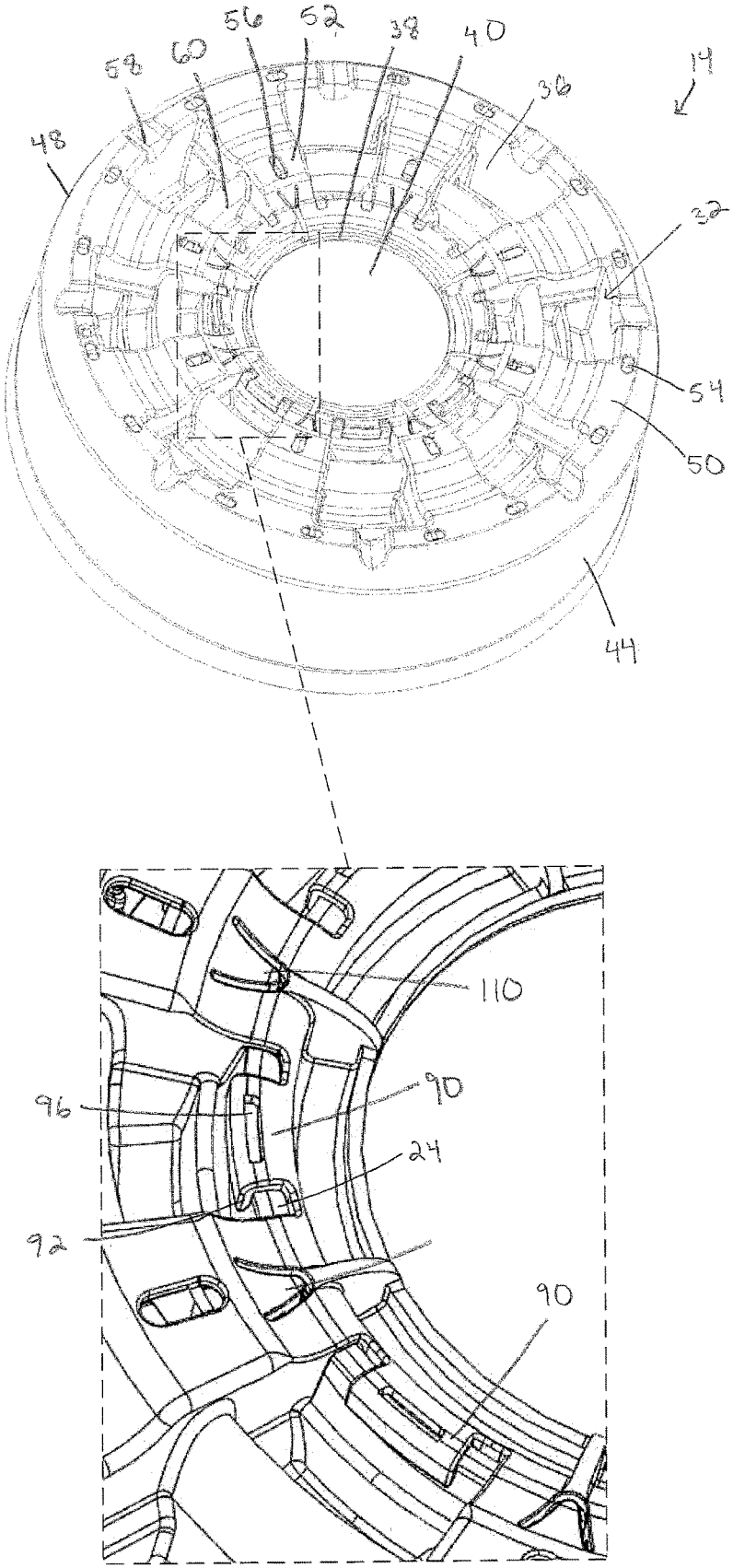
FIG. 3 is a bottom perspective view of an exemplary foot ring and collar of the portable gas cylinder.
Figure 4:
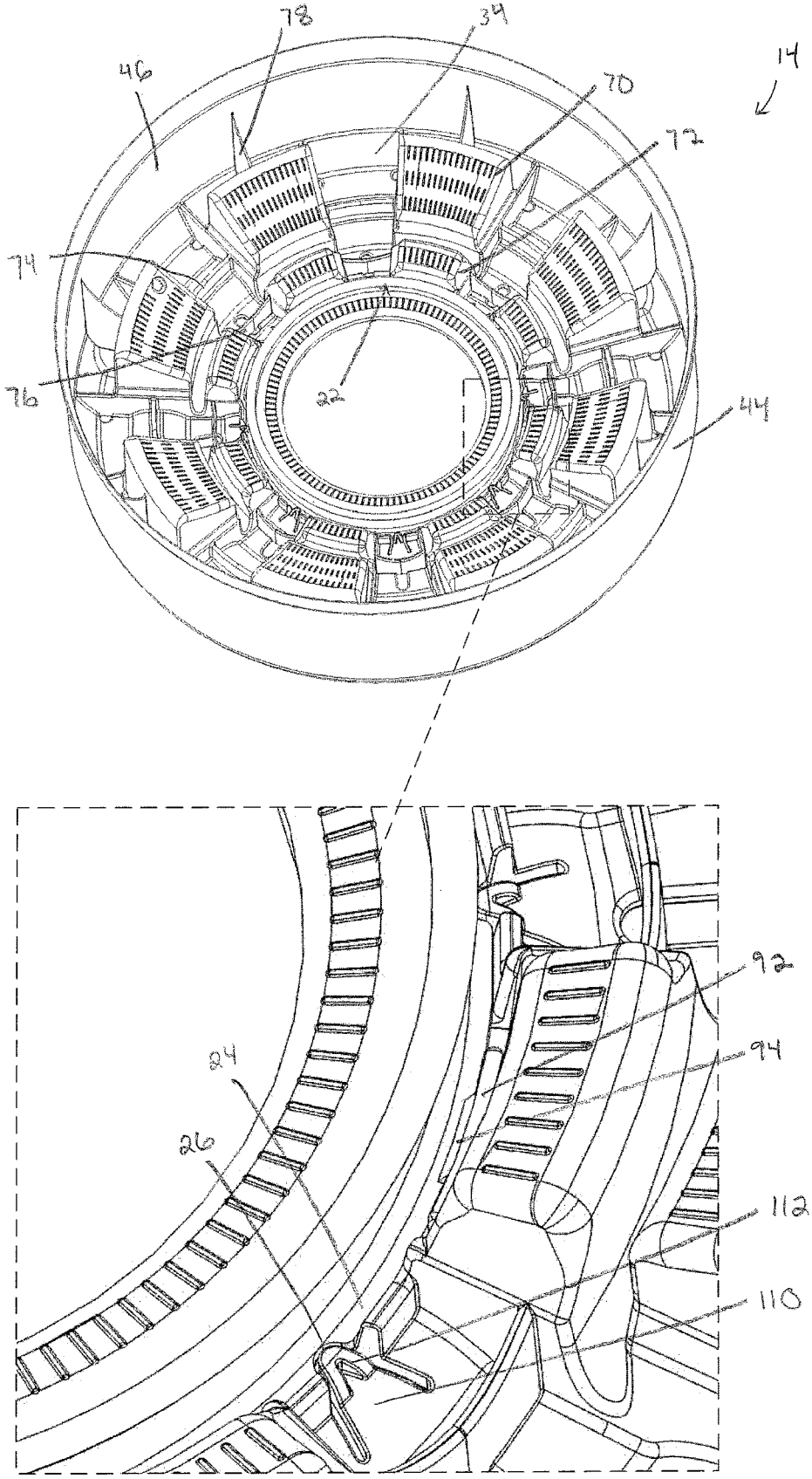
FIG. 4 is a top perspective view of the foot ring and collar.
Figure 5:
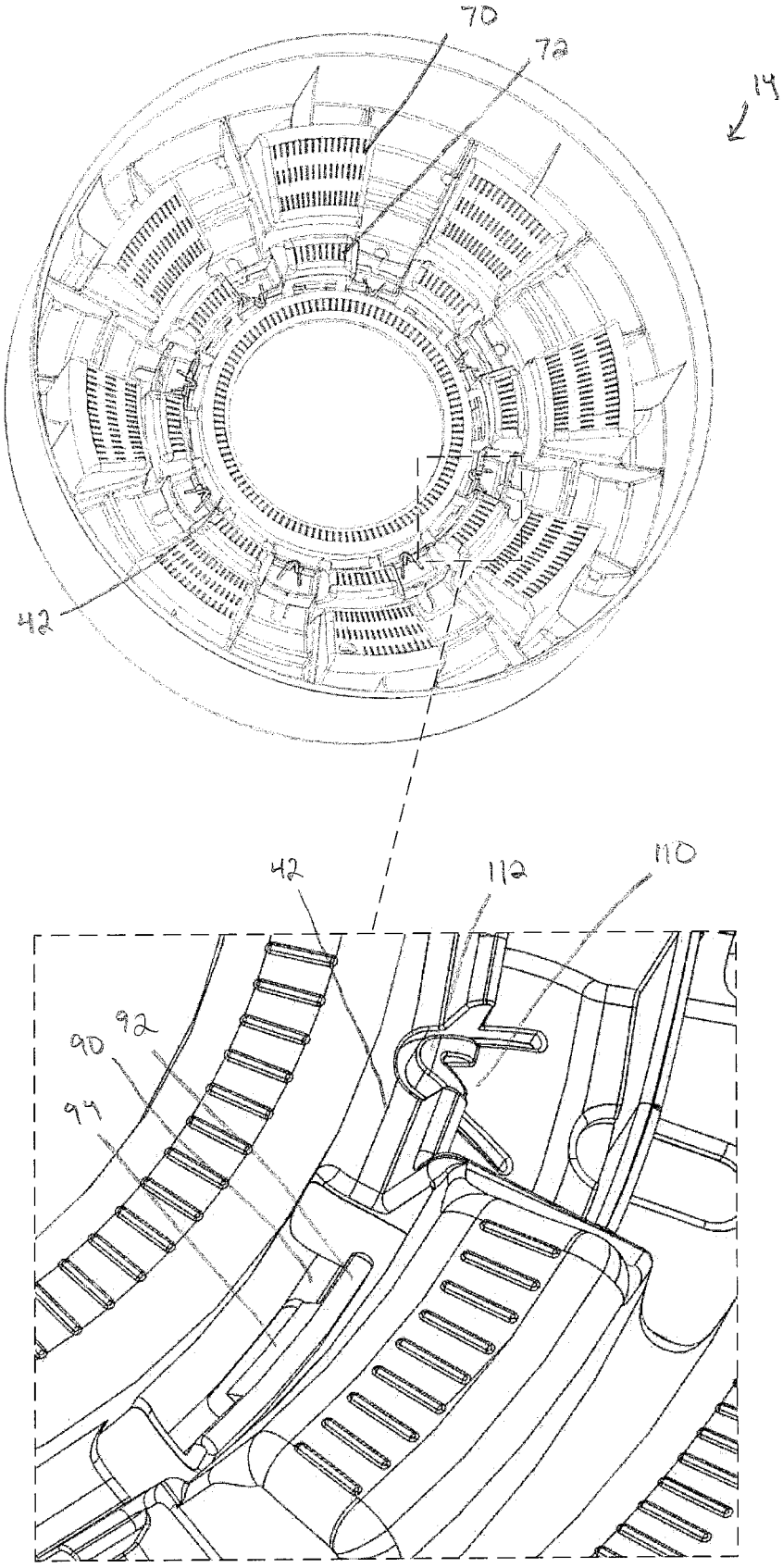
FIG. 5 is a top perspective view of the foot ring.
Figure 6:
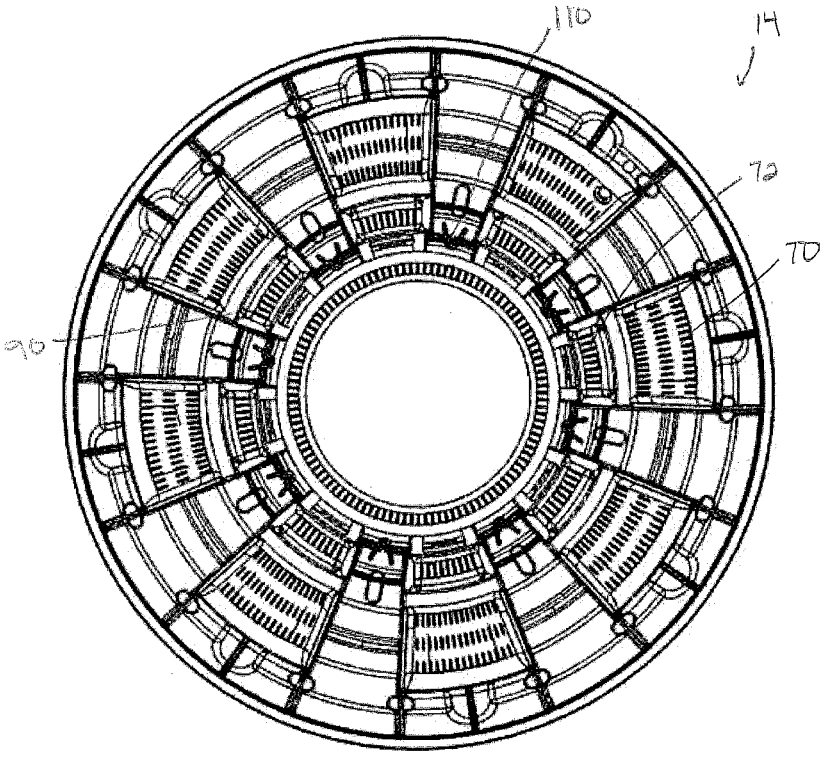
FIG. 6 is a top view of the foot ring.
Figure 7:
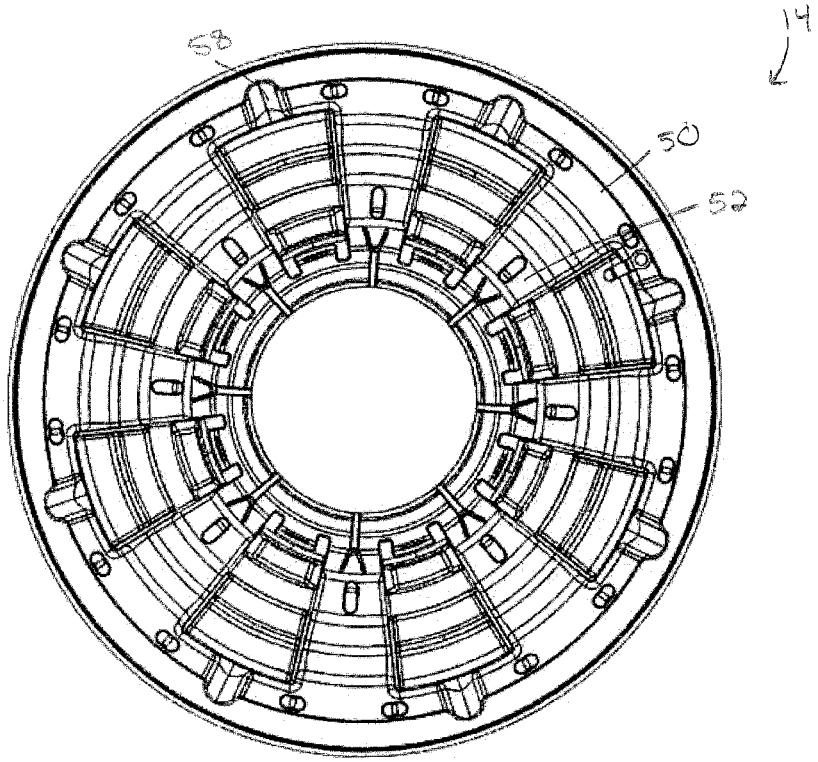
FIG. 7 is a bottom view of the foot ring.
Figure 8:
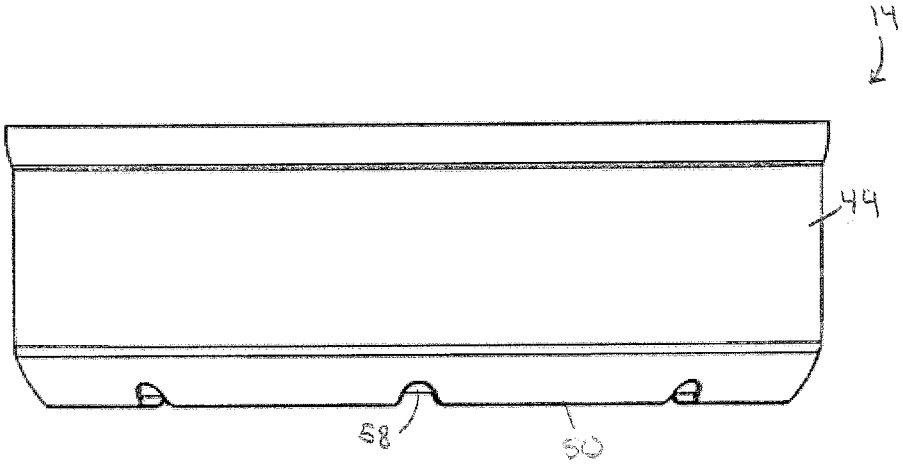
FIG. 8 is a side view of the foot ring.
Figure 9:
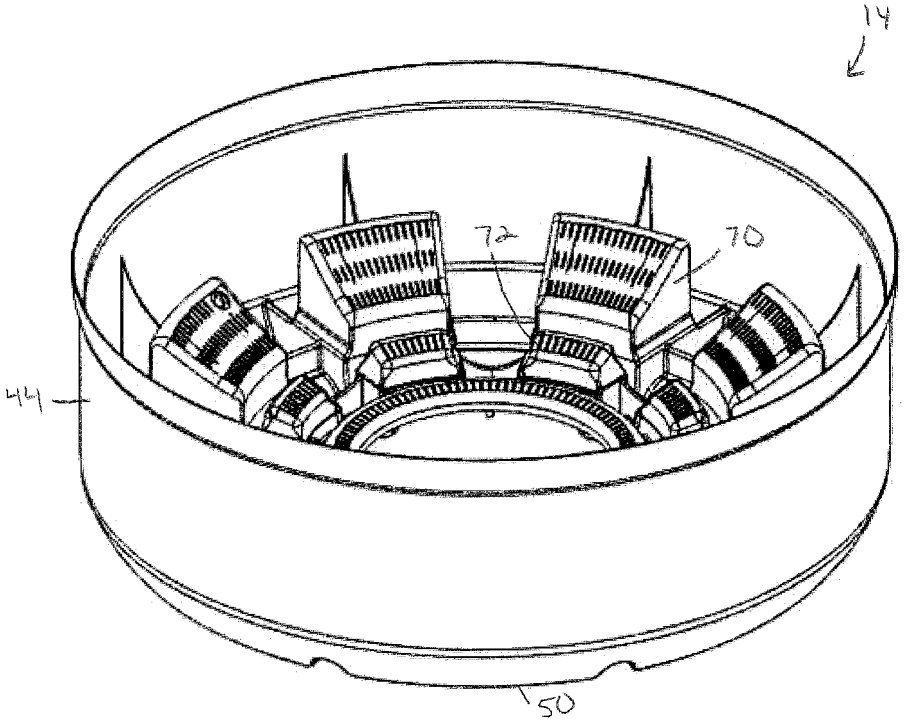
FIG. 9 is a side perspective view of the foot ring.
Figure 10:
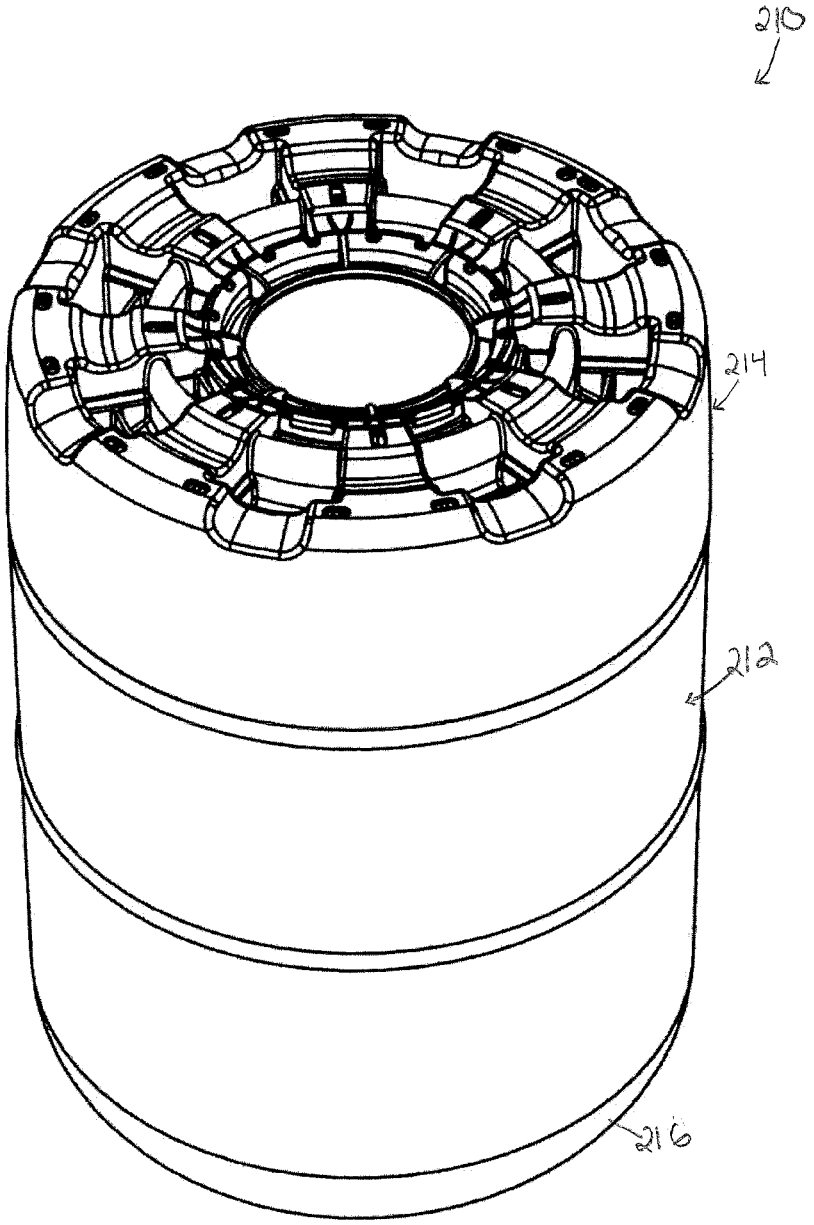
FIG. 10 is a bottom perspective view of another portable gas cylinder.
Figure 11:
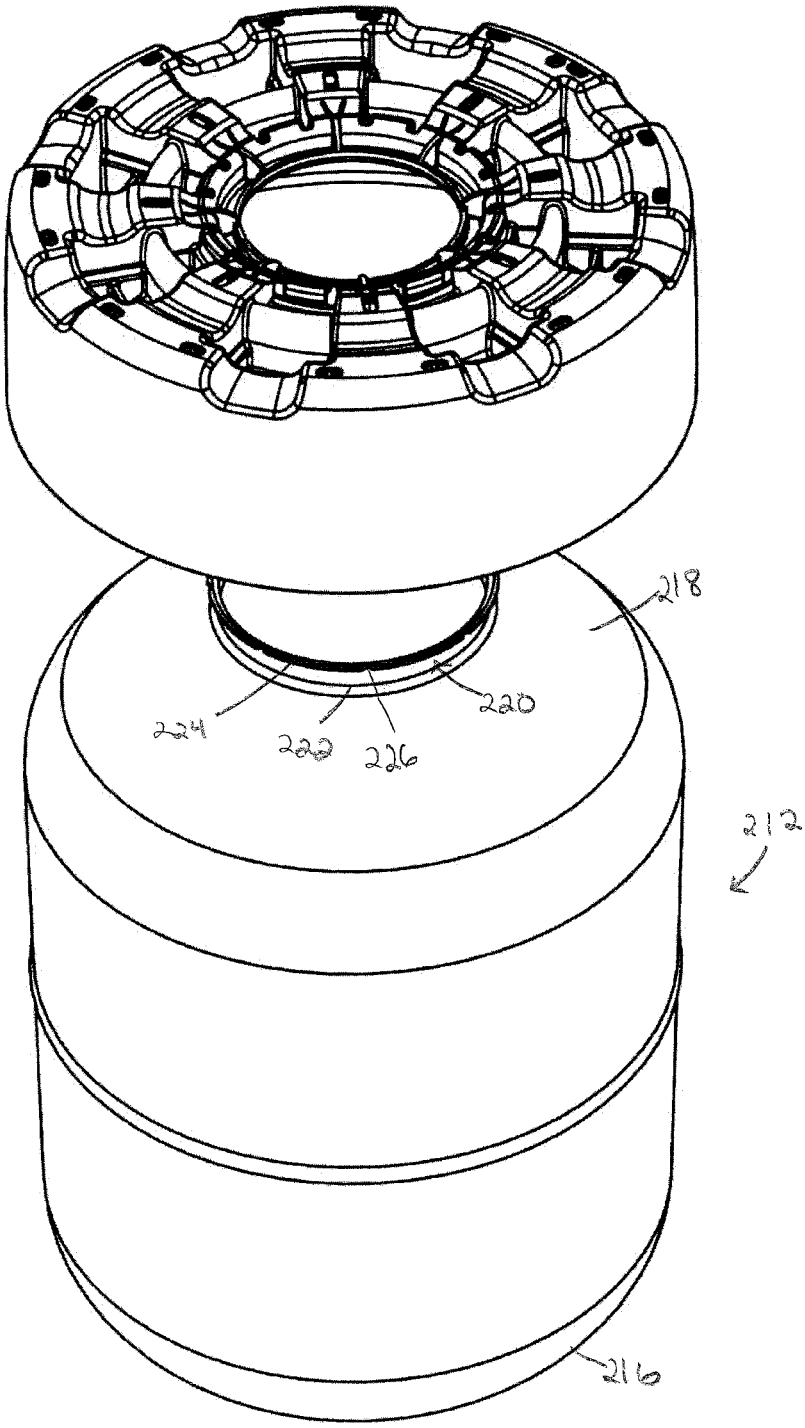
FIG. 11 is an exploded bottom perspective view of the portable gas cylinder of FIG. 10.
Figure 12:
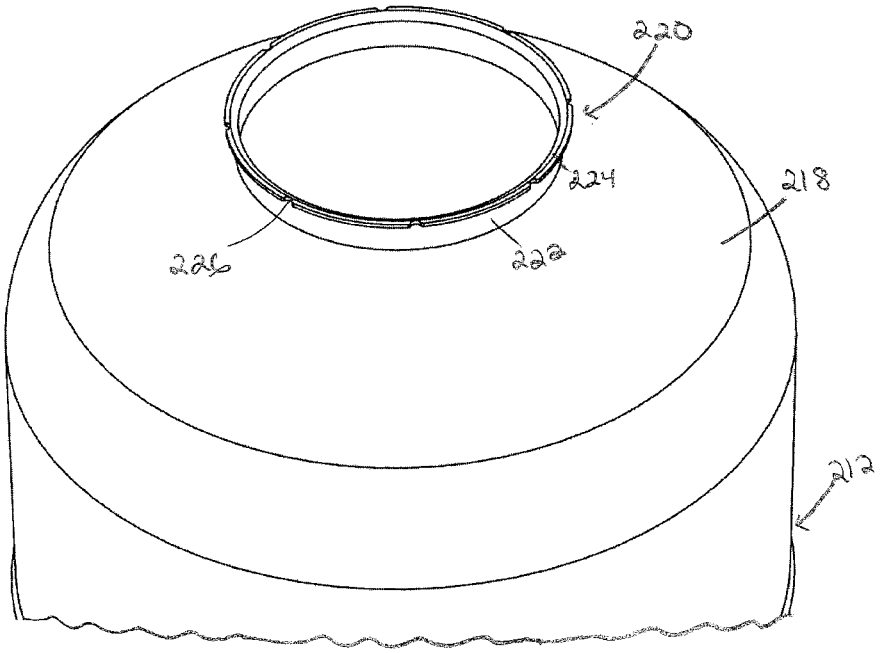
FIG. 12 is a perspective view of a gas tank of the portable gas cylinder.

Turning now to FIGS. 3-5, the foot ring 14 will be described in detail. The foot ring 14 may be formed in any suitable manner, such as by molding, and may be formed as one piece as shown or as multiple pieces attached together. The foot ring 14 includes a base 32 having inner and outer surfaces 34 and 36 and a central portion 38 with an opening 40 extending therethrough. The base 32 additionally has a channel 42 around the opening 40 on the inner surface 34 for receiving the collar 20. The base may have a suitable shape to match the geometry of the gas tank 12, and as shown is substantially circular in shape. Extending around and upward from an outer peripheral surface 48 of the base 32 is a skirt 44 having an inner surface 46 configured to abut the gas tank 12.

The foot ring 14 also includes a plurality of circumferentially spaced feet 50, 52 extending from the outer surface 36 of the base 32 for contacting a surface, such as a floor of a building. As shown, the foot ring 14 includes the plurality of circumferentially spaced feet 50 extending from the outer surface 36 at the periphery of the base 32, and the plurality of circumferentially spaced feet 52 extending from the outer surface 36 at an area radially inwardly spaced from the periphery. Each of the circumferentially spaced feet 50 may be radially aligned with one of the circumferentially spaced feet 52. The plurality of circumferentially spaced feet 50, 52 each include at least one opening 54, 56 extending therethrough for material savings and to allow liquid, such as water, to drain through the feet 50, 52 from within an inner area of the foot ring 14. As shown, each of the plurality of circumferentially spaced feet 50 include two openings 54 circumferentially spaced from one another and extending through the respective on of the plurality of circumferentially spaced feet 50 and each of the plurality of circumferentially spaced feet 52 include one opening 56 extending therethrough. The plurality of circumferentially spaced feet 50 are separated from adjacent ones of the plurality of circumferentially spaced feet 50 by recesses 58 extending toward the inner surface 34 and the plurality of circumferentially spaced feet 52 are separated by projections 60 in the outer surface 36 that form cavities in the inner surface 34.

The foot ring 14 additionally includes a plurality of circumferentially spaced shock absorbing members 70 and 72 extending from the inner surface 34 that form cavities in the outer surface 36 between circumferentially adjacent ones of the plurality of circumferentially spaced feet 50, 52. The shock absorbing members 70 and 72 are provided to absorb a shock, for example if the portable gas cylinder 10 was dropped on the surface, thereby preventing damage to the gas tank 12. For example, the shock absorbing members 70 and 72 can deform or bend to absorb energy without causing damage to the gas tank 12.

As shown, the foot ring 14 includes the plurality of circumferentially spaced shock absorbing members 70 extending from the inner surface 34 proximate the periphery of the base 32, and the plurality of circumferentially spaced shock absorbing members 72 extending from the inner surface 34 at an area radially inwardly spaced from the shock absorbing members 70. The plurality of circumferentially spaced shock absorbing members 70 and 72 are angled to abut and conform to the lower portion 18 of the gas tank 12. As shown, because of the contour of the lower portion 18, the plurality of circumferentially spaced shock absorbing members 70 extend from the inner surface farther than the plurality of circumferentially spaced shock absorbing members 72.

Each of the plurality of circumferentially spaced shock absorbing members 70 may be radially aligned with a respective one of the plurality of circumferentially spaced shock absorbing members 72 and radially spaced therefrom by one of the projections 60 that forms the cavity between the shock absorbing members 70 and 72. A support rib 74 is provided between adjacent ones of the plurality of shock absorbing members 70 and a support rib 76 is provided between adjacent ones of the plurality of shock absorbing members 72. A support spacer 78 is provided between each of the shock absorbing members 70 and the inner surface 46 of the skirt 44.

The foot ring 14 additionally includes a plurality of circumferentially spaced deflectable longitudinal lock tabs 90 extending around the base 32 for securing the foot ring 14 to the gas tank 12. When engaged, the deflectable longitudinal lock tabs 90 prevent movement of the foot ring 14 in a longitudinal direction parallel to an axis of the gas tank 12. As shown, the plurality of circumferentially spaced deflectable longitudinal lock tabs 90 extend radially outwardly from the central portion 38 of the base 32 and each have a projection 92 extending toward the inner surface 34 from a free end of the tab 90. The projections 92 define a radially outer portion of the channel 42 an each have an inner surface that is configured to abut a radially outer surface of the flange 24 of the collar 22. Each projection 92 also has a catch 94 for engaging an underside of the flange 24 to secure the foot ring 14 to the collar 22, thereby securing the foot ring to the gas tank 12. Each catch extends towards the central portion 38 from the inner surface of the respective projection 92. Each deflectable longitudinal lock tab 90 can include an opening 96 extending therethrough for material savings and to decrease the rigidity of the tab 90.

The foot ring 14 additionally includes a plurality of circumferentially spaced deflectable rotational lock tabs 110 extending around the base 32 for preventing rotational movement of the foot ring 14 relative to the gas tank 12 when the foot ring 14 is secured to the gas tank 12. As shown, the plurality of circumferentially spaced deflectable rotational lock tabs 110 extend radially inwardly from the base toward the central portion 38 and each have a projection 112 projecting toward the inner surface 34 from a free end of the tab 110. The projections 112 are shaped to fit within one of the notches 26 in the collar 20, and as shown, are curved to fit within the curved notches 26 such that sides of the curved projections 112 interact with sides of the curved notches 26 to prevent rotational movement of the foot ring 14 relative to the collar 20 in a circumferential direction. The plurality of circumferentially spaced deflectable longitudinal lock tabs 90 alternate with the plurality of circumferentially spaced deflectable rotational lock tabs 110 around the foot ring 14. The lock tabs 90 and 110 are positioned proximate the central portion 38 to be protected from shock, for example if the tank 12 is dropped, by the plurality of circumferentially spaced shock absorbing members 70 and 72 that are radially outwardly spaced from the lock tabs 90 and 110.

Turning now to FIGS. 10-21, an exemplary embodiment of the portable gas cylinder is shown at 210. The portable gas cylinder 210 is substantially the same as the above-referenced portable gas cylinder 10, and consequently the same reference numerals but indexed by 200 are used to denote structures corresponding to similar structures in the portable gas cylinders. In addition, the foregoing description of the portable gas cylinder 10 is equally applicable to the portable gas cylinder 210 except as noted below.

The portable gas cylinder 210 includes a gas tank 212 and a foot ring 214 attached to the gas tank 212. The gas tank 212 includes an upper portion 216 having a valve port (not shown), a lower portion 218, and a collar 220 secured to the lower portion 218. The collar 220 includes a base 222 that is attached to the lower portion 218, and a flange 224 extending around and radially outwardly from the base 222. The flange 224 includes a plurality of notches 226 circumferentially spaced around the flange 224 inward from an edge of the flange 24.

The foot ring 214 includes a base 232 having inner and outer surfaces 234 and 236 and a central portion 238 with an opening 240 extending therethrough. The base 232 additionally has a channel around the opening 240 on the inner surface 234 for receiving the collar 220. Extending around and upward from a periphery of the base 232 is a skirt 244 having an inner surface 246 configured to abut the gas tank 212.

The foot ring 214 also includes a plurality of circumferentially spaced feet 250, 252 extending from the outer surface 236 of the base 232 for contacting a surface, such as a floor of a building. As shown, the foot ring 214 includes the plurality of circumferentially spaced feet 250 extending from the outer surface 236 at the periphery of the base 232, and the plurality of circumferentially spaced feet 252 extending from the outer surface 236 at an area radially inwardly spaced from the periphery. The plurality of circumferentially spaced feet 250 are separated from adjacent ones of the plurality of circumferentially spaced feet 250 by recesses 258 extending toward the inner surface 234 and the plurality of circumferentially spaced feet 252 are separated by projections 260 in the outer surface 236 that form cavities in the inner surface 234.

The foot ring 14 additionally includes a plurality of circumferentially spaced shock absorbing members 270 and 272 extending from the inner surface 234 that form cavities in the outer surface 236 between circumferentially adjacent ones of the plurality of circumferentially spaced feet 250, 252. A support rib is provided between adjacent ones of the plurality of shock absorbing members 270 and a support rib is provided between adjacent ones of the plurality of shock absorbing members 272. A support spacer is provided between each of the shock absorbing members 270 and the inner surface 246 of the skirt 244.

The foot ring 214 additionally includes a plurality of circumferentially spaced deflectable longitudinal lock tabs 290 extending around the base 232 for securing the foot ring 214 to the gas tank 212. The plurality of circumferentially spaced deflectable longitudinal lock tabs 290 extend radially outwardly from the central portion 238 of the base 232 and each have a projection 292 projecting toward the inner surface 234. The projections 292 define a radially outer portion of the channel an each have an inner surface that is configured to abut a radially outer surface of the flange 224 of the collar 222. Each projection 292 also has a catch 294 for engaging an underside of the flange 224 to secure the foot ring 214 to the collar 222.

The foot ring 214 additionally includes a plurality of circumferentially spaced deflectable rotational lock tabs 310 extending around the base 232. The plurality of circumferentially spaced deflectable rotational lock tabs 310 extend radially inwardly from the base toward the central portion 238 and each have a projection 312 projecting toward the inner surface 234. The projections 312 are shaped to fit within one of the notches 226 in the collar 220, and as shown, are curved to fit within the curved notches 226.

Turning now to FIGS. 13-21, the attachment of the foot ring 214 to the gas tank 212 will be described in detail. It will be appreciated that the following attachment method is equally applicable to the attachment of the foot ring 14 to the gas tank 12.

Figure 13:
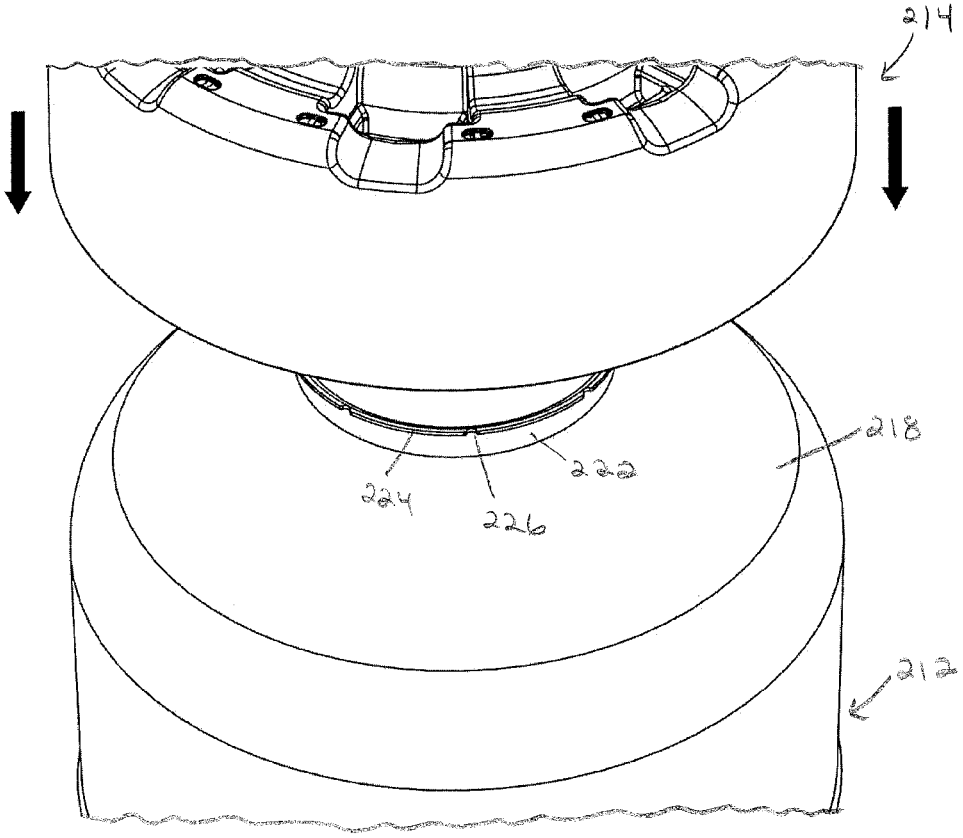
FIG. 13 is a perspective view of the foot ring being attached to the gas tank.

Referring initially to FIG. 13, the foot ring 214 is shown being lowered onto the gas tank 212 while the gas tank 212 is upside down. It will be appreciated that the foot ring 214 and gas tank 212 may be in any suitable position for attachment, and that the attachment may be done by hand or by a machine, such as on an assembly line.

Figure 14:
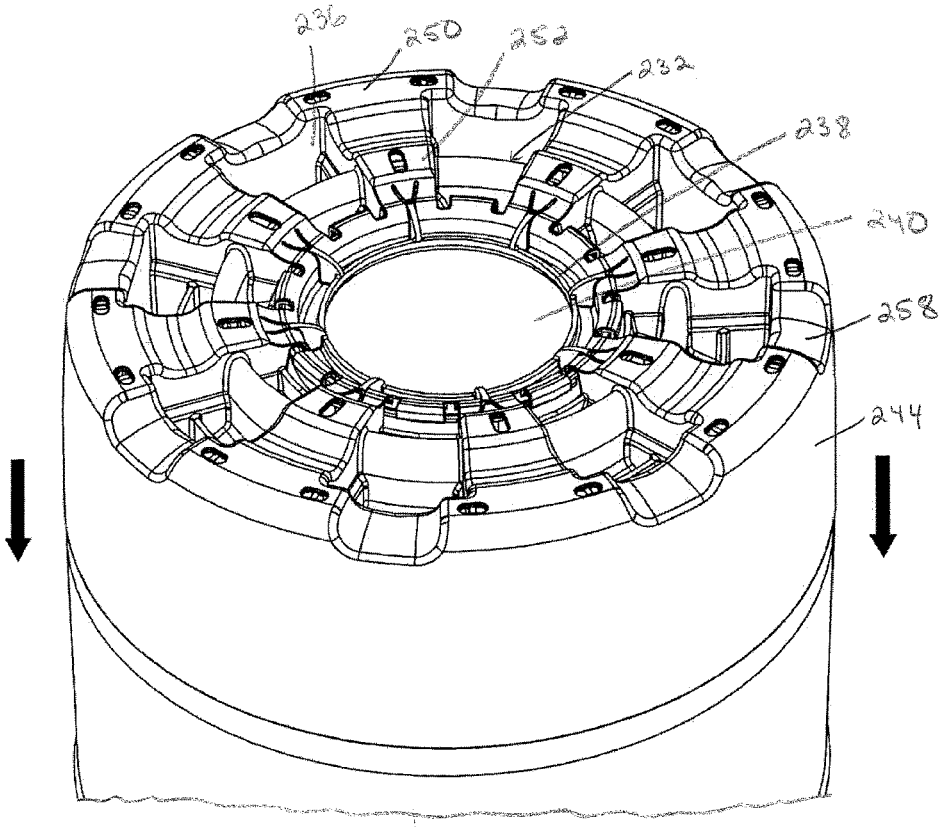
FIG. 14 is another perspective view of the foot ring being attached to the gas tank.
Figure 15:
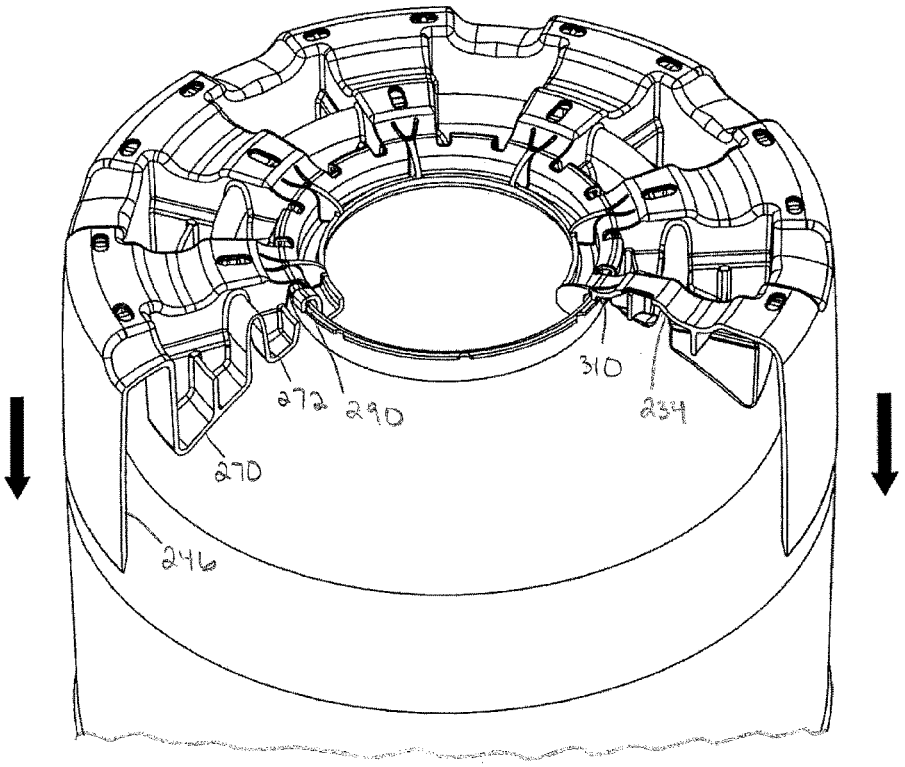
FIG. 15 is still another perspective view of the foot ring being attached to the gas tank with a portion of the foot ring cut away.
Figure 16:
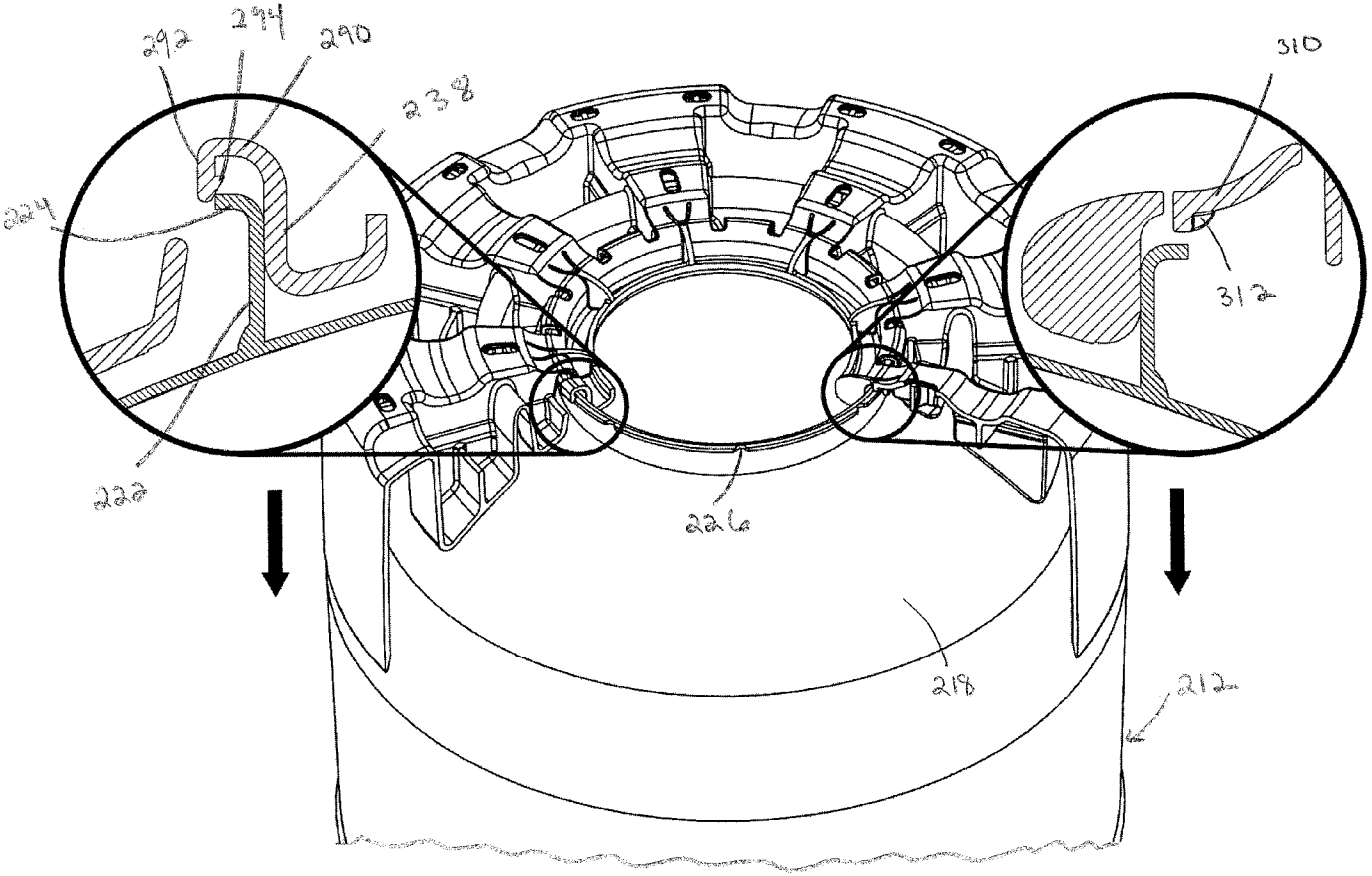
FIG. 16 is yet another perspective view of the foot ring being attached to the gas tank with a portion of the foot ring cut away.

Referring next to FIGS. 14-16, the foot ring 214 is shown in a position prior to attachment to the gas tank 212, where FIG. 15 shows a cut-away of FIG. 14 and FIG. 16 shows enlarged portions of FIG. 15. As illustrated, as the foot ring 214 is lowered onto the gas tank 212, the projections 292 and corresponding catches 294 come in contact with the flange 224 of the collar 220 and a radially outer surface of the central portion 238 abuts an inner surface of the base 222 of the collar 220.

Figure 17:
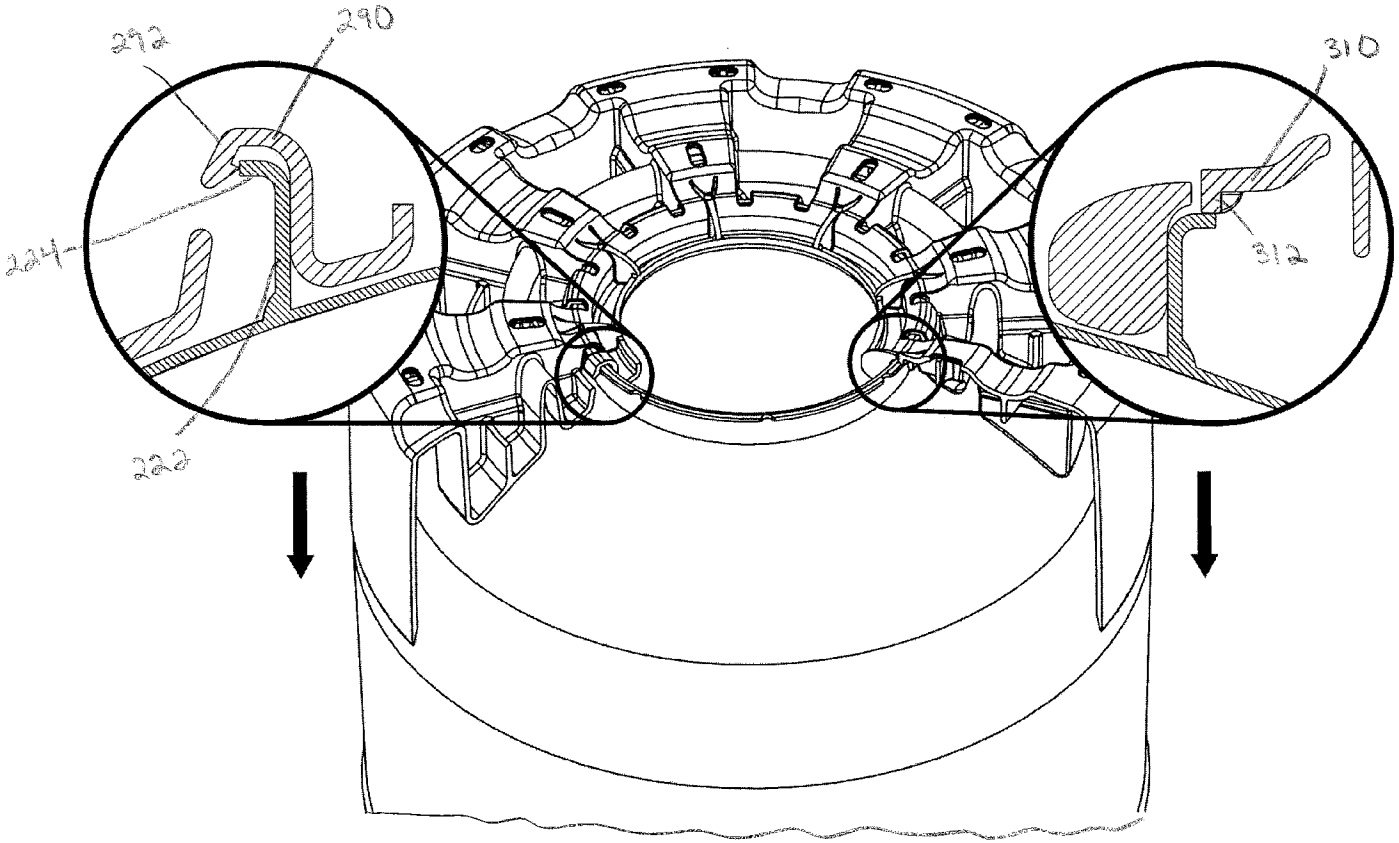
FIG. 17 is a further perspective view of the foot ring being attached to the gas tank with a portion of the foot ring cut away.

Referring next to FIG. 17, as the foot ring 214 is lowered further onto the gas tank 212, the projections 292 of the plurality of circumferentially spaced deflectable longitudinal lock tabs 290 are deflected radially outwardly by the flange 224 and the projections 312 of the plurality of circumferentially spaced deflectable rotation lock tabs 310 abut a top of the flange 224.

Figure 18:
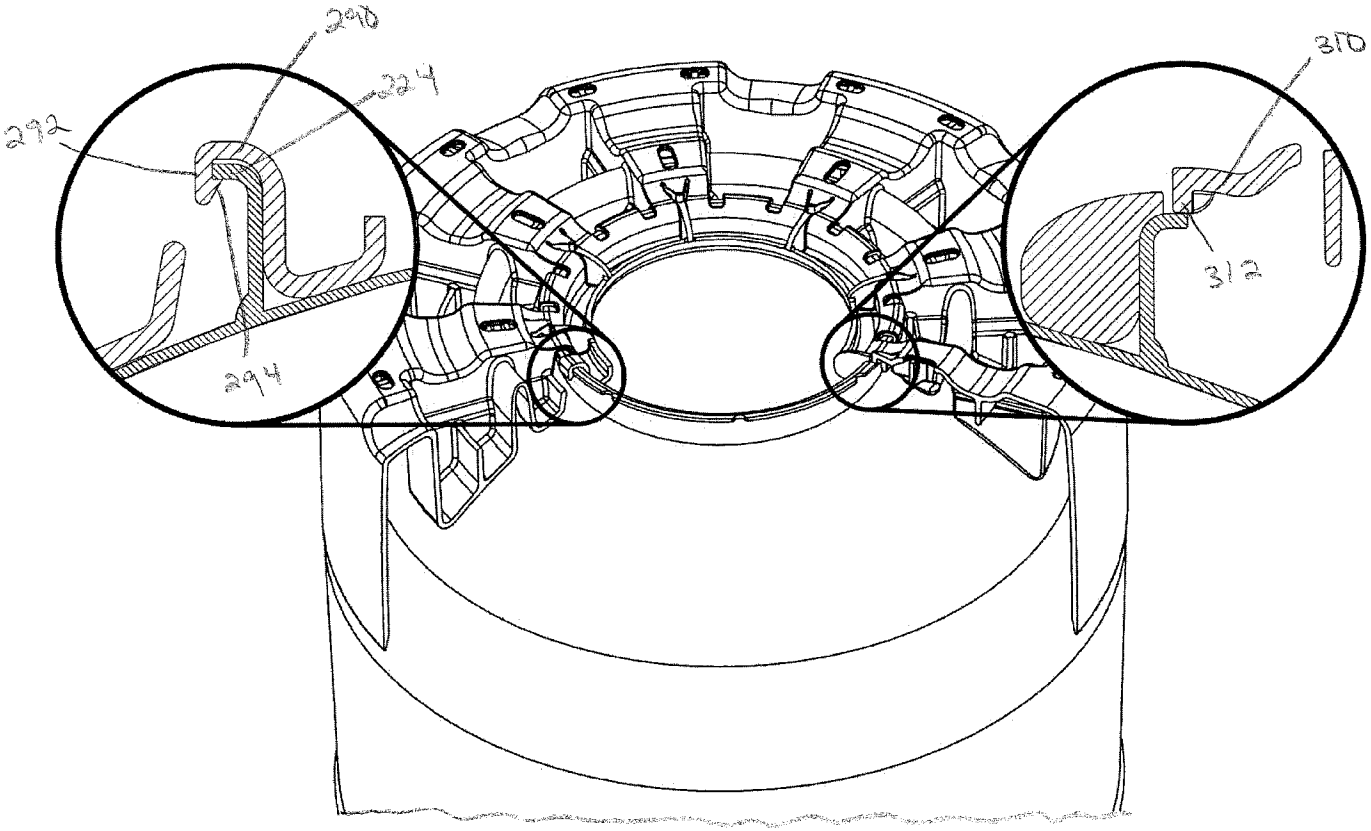
FIG. 18 is another perspective view of the foot ring being attached to the gas tank with a portion of the foot ring cut away.
Figure 15:
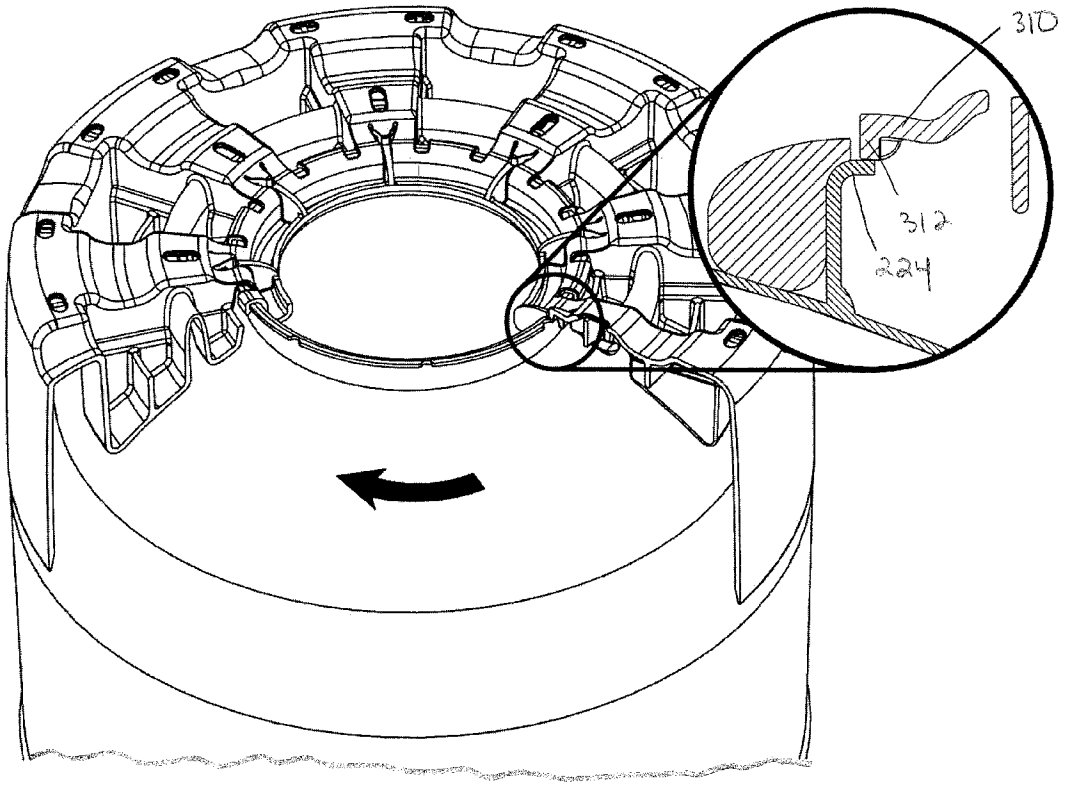

Referring next to FIG. 18, the foot ring 214 is shown engaged with the gas tank 212. As the foot ring 214 is lowered from the position shown in FIG. 17 to the position shown in FIG. 18, the catches 294 of the projections 292 have moved passed the flange 224 of the collar 220 such that an inner surface of the projections 292 abut the radially outer surface of the flange 224 and the catches 294 engage an underside of the flange 224. The plurality of circumferentially spaced deflectable longitudinal lock tabs 290 are thereby in an unbiased position and the foot ring 214 is secured to the tank 212 in the longitudinal direction. In this position the projections 312 continue to abut the top of the flange 224 and the plurality of circumferentially spaced deflectable rotation lock tabs 310 are deflected by the flange 224.

Referring next to FIG. 19, the foot ring 214 is shown rotated clockwise relative to the tank 212, although it will be appreciated that the foot ring 214 could also be rotated counterclockwise. In this position the foot ring 214 is secured in the longitudinal direction but is not locked against rotational movement. As the foot ring 214 is rotated, the flange 224 is moved through the channel in the base 232.

Figure 20:
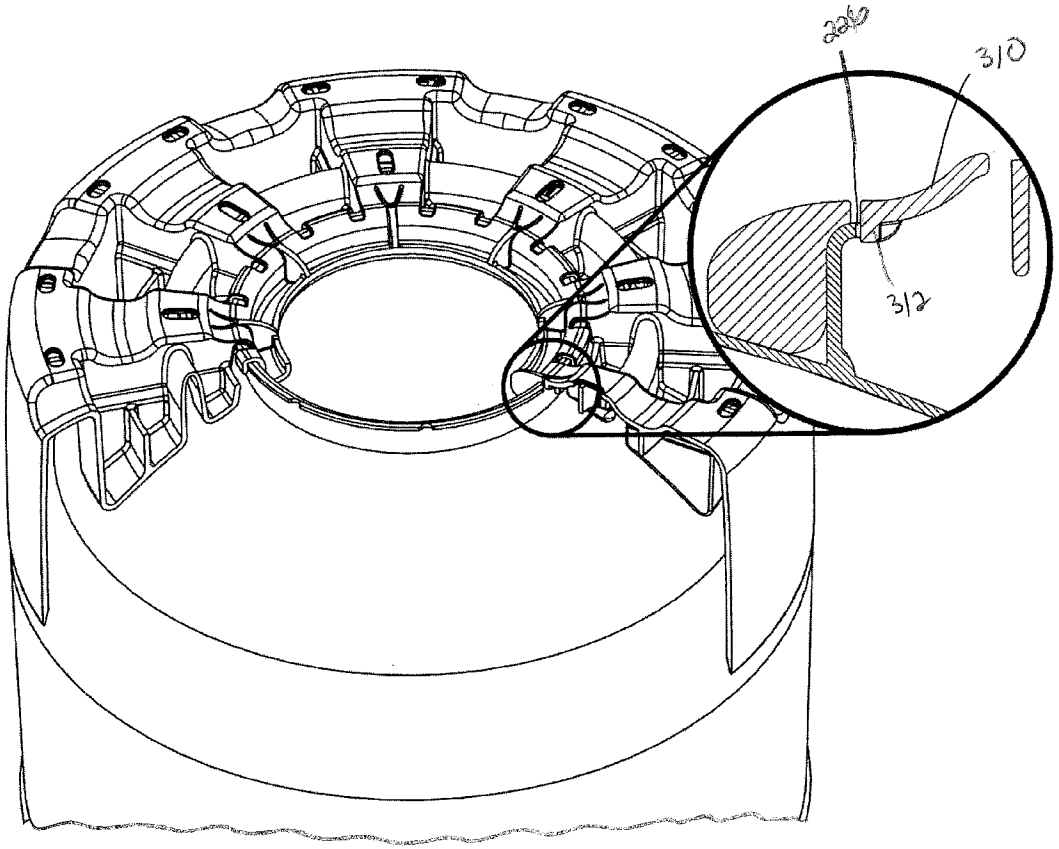
FIG. 20 is a perspective view of the foot ring attached to the gas tank with a portion of the foot ring cut away.
Figure 21:
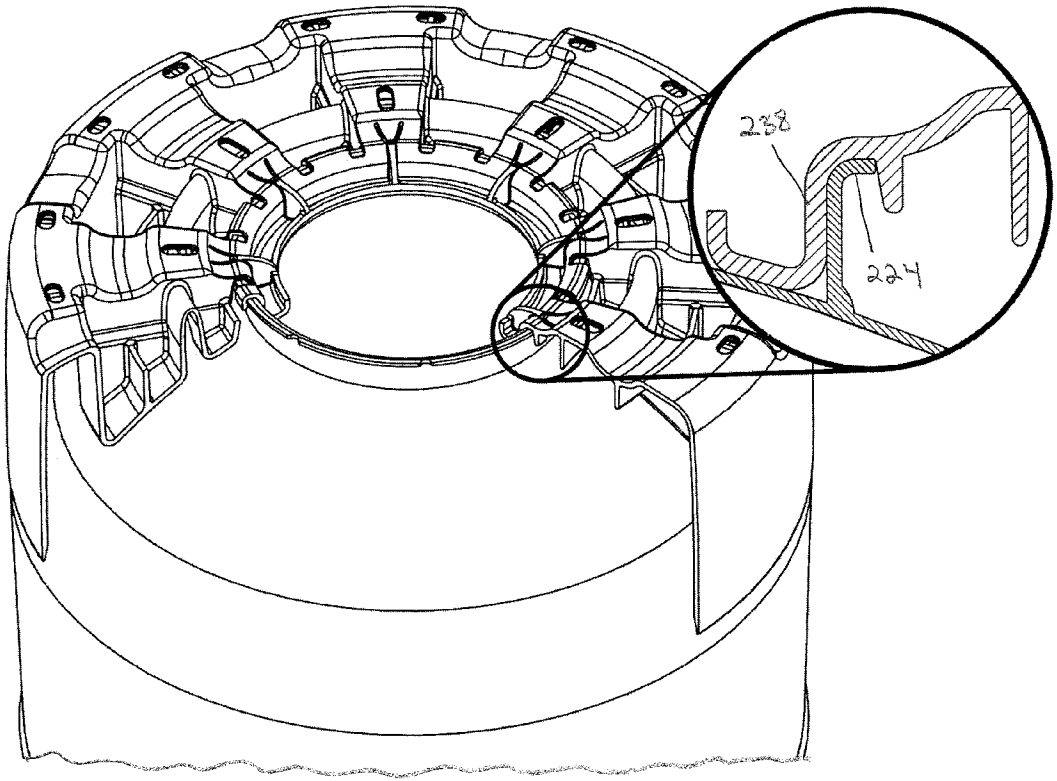
FIG. 21 is a perspective view of the foot ring attached to the gas tank with a portion of the foot ring cut away.

Referring next to FIGS. 20 and 21, the foot ring 214 is shown rotated clockwise relative to the tank 212 until the plurality of circumferentially spaced deflectable rotation lock tabs 310 are in an unbiased position with the projections 312 received in respective ones of the plurality of notches 226. As best shown in FIG. 4, in this position sides of the curved projections 112, 312 interact with sides of the curved notches 26, 226 to prevent rotational movement of the foot rings 14, 214 relative to the collars 20, 220 in the circumferential direction.

The aforementioned systems, components, (e.g., foot, cylinders, among others), and the like have been described with respect to interaction between several components and/or elements. It should be appreciated that such devices and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

While the embodiments discussed herein have been related to the systems and methods discussed above, these embodiments are intended to be exemplary and are not intended to limit the applicability of these embodiments to only those discussions set forth herein.

The above examples are merely illustrative of several possible embodiments of various aspects of the present invention, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (e.g., that is functionally equivalent), even though not structurally equivalent to the disclosed structure which performs the function in the illustrated implementations of the invention. In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The best mode for carrying out the invention has been described for purposes of illustrating the best mode known to the applicant at the time and enable one of ordinary skill in the art to practice the invention, including making and using devices or systems and performing incorporated methods. The examples are illustrative only and not meant to limit the invention, as measured by the scope and merit of the claims. The invention has been described with reference to preferred and alternate embodiments. Modifications and alterations will occur to others upon the reading and understanding of the specification. It is intended to include all such modifications and alterations insofar as they come within the scope of the appended claims or the equivalents thereof. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A foot ring configured to be secured to a tank having a collar, the foot ring comprising:

a base having an inner and outer surface, a central portion, and an outer peripheral portion;

a plurality of circumferentially spaced deflectable longitudinal lock tabs that extend around the base radially outwardly from the central portion for securing the foot ring to the tank, each of the circumferentially spaced deflectable longitudinal lock tabs having a first projection extending toward the inner surface of the base and a catch that extends from the respective first projection toward the central portion for engaging a flange of the collar; and a plurality of circumferentially spaced deflectable rotational lock tabs that extend around the base radially inwardly toward the central portion for preventing rotational movement of the foot ring relative to the tank, each of the circumferentially spaced deflectable rotational lock tabs having a second projection extending toward the inner surface of the base configured to be received in a respective notch in the flange.

2. The foot ring according to claim 1, wherein each first projection has an inner surface configured to abut a radially outer surface of the flange of the collar, and each catch is configured to engage an underside of the flange.

3. The foot ring according to claim 2, wherein each catch extends towards the central portion of the base from the inner surface of the respective first projection.

4. The foot ring according to claim 1, wherein each second projection is curved to interact with curved sides of the notches to prevent rotation of the foot ring.

5. The foot ring according to claim 1, wherein the plurality of circumferentially spaced deflectable longitudinal lock tabs alternate with the plurality of circumferentially spaced deflectable rotational lock tabs around the foot ring.

6. The foot ring according to claim 1, wherein the plurality of circumferentially spaced deflectable longitudinal lock tabs and the plurality of circumferentially spaced deflectable rotational lock tabs are positioned proximate the central portion of the base to be protected from shock.

7. The foot ring according to claim 1, further including a skirt that extends around and upward from the outer peripheral portion of the tank, the skirt having an inner surface configured to abut the tank.

8. The foot ring according to claim 1, further including a plurality of circumferentially spaced feet that extend from the outer surface at the outer peripheral portion, and a plurality of circumferentially spaced feet that extend from the outer surface at an area radially inwardly spaced from the outer peripheral portion.

9. The foot ring according to claim 1, further including a first plurality of circumferentially spaced shock absorbing members that extend from the inner surface proximate the outer peripheral portion, and a second plurality of circumferentially spaced shock absorbing members that extend from the inner surface at an area radially inwardly spaced from the first plurality of circumferentially spaced shock absorbing members.

10. The foot ring according to claim 9, further including first support ribs between adjacent ones of the first plurality of circumferentially spaced shock absorbing members, and second support ribs between adjacent ones of the second plurality of circumferentially spaced shock absorbing members.

11. The foot ring according to claim 9, wherein the first and second plurality of circumferentially spaced shock absorbing members are angled to abut and conform to a lower portion of the tank.

12. The foot ring according to claim 11, wherein the first plurality of circumferentially spaced shock absorbing members extends from the inner surface farther than the second plurality of circumferentially spaced shock absorbing members.

13. A portable gas cylinder comprising:

a gas tank having an upper portion, a lower portion, and a collar, the collar including a base secured to the lower portion, a flange that extends around and radially outwardly from the base, and a plurality of notches circumferentially spaced around the flange; and a foot ring configured to be attached to the gas tank, the foot ring including:

a base having an inner and outer surface, a central portion, and an outer peripheral portion;

a plurality of circumferentially spaced deflectable longitudinal lock tabs that extend around the base for securing the foot ring to the tank, each of the circumferentially spaced deflectable longitudinal lock tabs having a first projection with an inner surface configured to abut a radially outer surface of the flange, and a catch that extends from the respective first projection for engaging an underside of the flange to secure the foot ring to the tank; and a plurality of circumferentially spaced deflectable rotational lock tabs that extend around the base for preventing rotational movement of the foot ring relative to the tank, each of the circumferentially spaced deflectable rotational lock tabs having a second projection configured to be received in a respective one of the notches.

14. The portable gas cylinder according to claim 13, wherein the plurality of circumferentially spaced deflectable longitudinal lock tabs extend radially outwardly from the central portion of the base, wherein each first projection extends toward the inner surface of the base from a free end of the respective circumferentially spaced deflectable longitudinal lock tab, and wherein each catch extends towards the central portion of the base from the inner surface of the respective first projection.

15. The portable gas cylinder according to claim 13, wherein the plurality of circumferentially spaced deflectable rotational lock tabs extend radially inwardly from the base toward the central portion, wherein each second projection extends toward the inner surface of the base from a free end of the respective circumferentially spaced deflectable rotational lock tab.

16. The portable gas cylinder according to claim 13, wherein each second projection is curved to interact with curved sides of the notches to prevent rotation of the foot ring.

17. The portable gas cylinder according to claim 13, further including a first plurality of circumferentially spaced shock absorbing members that extend from the inner surface proximate the outer peripheral portion, and a second plurality of circumferentially spaced shock absorbing members that extend from the inner surface at an area radially inwardly spaced from the first plurality of circumferentially spaced shock absorbing members.

18. A method of attaching a foot ring to a tank having a collar with a flange, the method comprising:

advancing the foot ring toward the collar until a plurality of circumferentially spaced deflectable longitudinal lock tabs are engaged with the collar to secure the foot ring to the tank, wherein each of the circumferentially spaced deflectable longitudinal lock tabs have a first projection with an inner surface that abuts a radially outer surface of the flange and a catch extending from a respective one of the first projections for engaging an underside of the flange; and rotating the foot ring until a plurality of circumferentially spaced deflectable rotational lock tabs engage with notches in the flange thereby preventing rotational movement of the foot ring relative to the tank.

* * * * *